United States Patent [19]

Van Malderghem

[11] 4,126,334

[45] Nov. 21, 1978

[54] STUBLESS MULTI-PLY ASSEMBLY

[75] Inventor: Edmund G. Van Malderghem, Lewiston, N.Y.

[73] Assignee: Moore Business Forms, Inc., Niagara Falls, N.Y.

[21] Appl. No.: 818,759

[22] Filed: Jul. 25, 1977

[51] Int. Cl.[2] ..... B41L 1/24

[52] U.S. Cl. ..... 282/22 R; 282/28 R; 282/29 R

[58] Field of Search ..... 282/28 R, 29 R, 29 C, 282/24 R, 22 R

[56] References Cited

U.S. PATENT DOCUMENTS

| | | | |
|---|---|---|---|
| 3,981,523 | 9/1976 | Maalouf | 282/28 R X |
| 4,039,046 | 8/1977 | D'Luhy | 282/24 R X |

*Primary Examiner*—Travis S. McGehee

*Attorney, Agent, or Firm*—Watson, Cole, Grindle & Watson

[57] ABSTRACT

A unit set of multiple plies includes superimposed top, intermediate and bottom plies each being devoid of any tear lines which may form a stub, and each being coated on selected surfaces thereof with chemicals which are capable of reacting with one another to produce a colored mark. The top and bottom plies are interconnected by means of a removable glue flap, and portions of the glue extend through holes lying along a margin of the bottom ply so as to thereby interconnect the intermediate and bottom plies together. The top ply is coated front and back and the intermediate ply is coated on its back surface with a micro-encapsulated color precursor, while the bottom ply is coated front and back and the top surface of the intermediate ply is coated with a record-developing material. Upon application of pressure to the set, colored marks are formed on the intermediate and bottom ply top surfaces as the reactive components of the coatings on mating surfaces react. The plies are capable of rearrangement such that by removal of the intermediate ply and by placing the backs of the top and bottom plies in mating engagement colored marks are produced on the backs of the plies as the reactive components of the coatings of these mating surfaces are forced into reactive contact upon the application of pressure to the back of the set.

The unit set may also include at least two of such intermediate plies, similarly coated as the intermediate ply of the three-ply set so that, upon application of pressure to the set, colored marks are formed on both intermediate and bottom ply top surfaces as the reactive components of the coatings on mating surfaces react. Portions of the glue extend through aligned holes lying along the margins of the lower intermediate and bottom plies, the latter being smaller than the former so as to mask portion of the glue extending therethrough. And, the plies are capable of rearrangement as in the three-ply set upon removal of both intermediate plies.

4 Claims, 5 Drawing Figures

STUBLESS MULTI-PLY ASSEMBLY

BACKGROUND OF THE INVENTION

This invention relates generally to a stubless multi-ply assembly having carbonless transfer material on each of the surfaces thereof, and more particularly to such an assembly which is capable of both separation and rearrangement so that colored marks may be produced on the fronts and backs of the plies upon application of pressure to the front and back of the set.

U.S. Pat. No. 3,981,523, and U.S. Ser. No. 664,941, filed Mar. 8, 1976 as a divisional thereof, now U.S. Pat. No. 4,036,511, are both commmonly owned with the present application and disclose sets of manifold business forms comprising stacks of sheets having one or both surfaces of the sheets coated with carbonless transfer material for the development of images on both sides of the sheets upon the application of pressure to opposite sides of the sets. On the other hand, U.S. Ser. No. 623,393, filed Oct. 17, 1975, now U.S. Pat. No. 4,039,046, likewise commonly owned herewith, discloses a stubless multi-part assembly wherein the parts are interconnected as a unit set without reliance on a stub yet are capable of easy separation and manipulation.

The aforedescribed stacks of business forms and unit set of multiple parts, nevertheless, are not without their limitations. The stacks of forms are not interconnected as a set capable of separation during use as a correspondence assembly, and the stubless unit set is incapable of having images developed on both sides of the sheets upon removal of a sheet and rearrangement of them.

SUMMARY OF THE INVENTION

It is therefore an object of the present invention to provide a stubless multi-ply assembly which permits more effective and economical use of the plies without the need for the handling and disposal of a stub, while at the same time permits the assembly to be rearranged so that marks are produced thereon upon application of pressure to both sides of the set.

In carrying out this objective the unit set according to the invention comprises at least three superimposed parts, the top and bottom parts being interconnected by means of a removable glue flap on the top part, and the intermediate part or parts and bottom part being interconnected as portions of the glue on the flap extend through holes located in the bottom part (and the lower intermediate part, if one is provided). Both surfaces of the top part and the bottom surface of the intermediate part or parts are coated with a microencapsulated color precursor while both surfaces of the bottom part and the top surface of the intermediate part or parts are coated with a composition of a record-developing material. The coatings each comprise an initially colorless color-forming reactive component capable of reacting to produce a colored mark upon the application of pressure to the set as the coatings on mating surfaces are forced into reactive contact with one another. And, the set is capable of rearrangement so that upon removal of the intermediate part or parts and the folding over of the top and bottom parts so that the top of the first part and the bottom of the bottom part surfaces are in mating contact, another colored mark may be produced upon application of pressure to the reverse side of the rearranged set as the coatings on the mating surfaces are forced into reactive contact with one another.

DETAILED DESCRIPTION OF THE INVENTION

Figure 2:
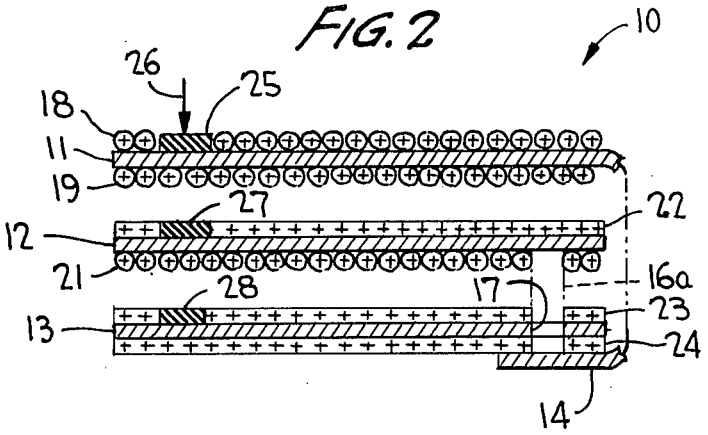
FIG. 2 is a cross-sectional view of the FIG. 1 assembly showing the manner of using the assembly by producing colored marks on one side of the plies thereof.
Figure 1:
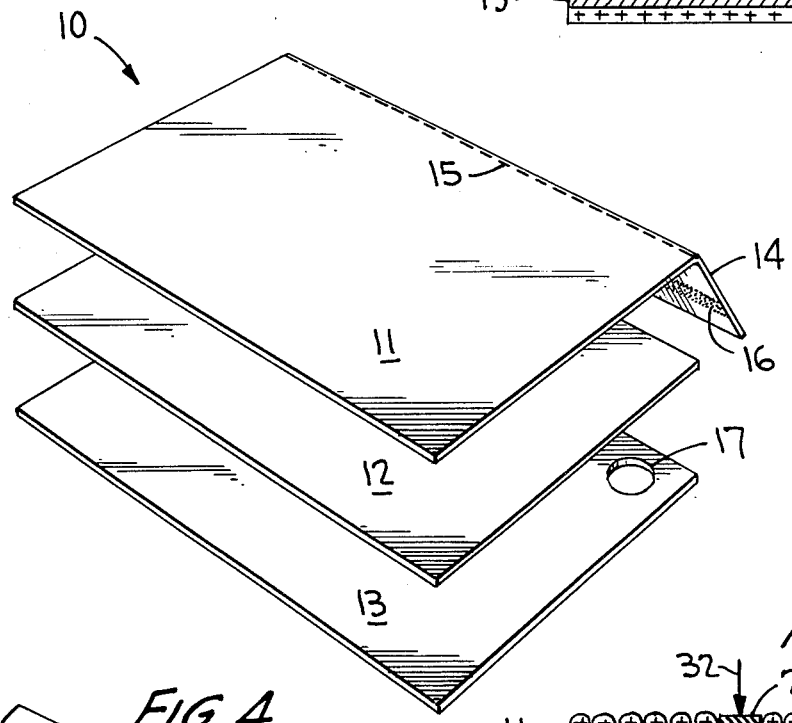
FIG. 1 is an expanded perspective view of a three-ply stubless assembly according to the invention.

Turning now to the drawings wherein like reference characters refer to like and corresponding parts throughout the several views, an assembly generally designated 10 is shown in FIG. 1 as comprising three superimposed plies or parts 11, 12 and 13. The top or first ply 11 is provided with a removable flap 14 connected to one edge thereof along a fold line 15 of perforations. This flap is provided with a glue stream 16 substantially parallel to line 15 and aligned with a plurality of holes 17 provided in the bottom or third ply 13 along its marginal edge which underlies line 15. Flap 14 is folded to underlie bottom ply 13 (see FIG. 2) and is secured thereto for interconnecting plies 11 and 13 together. Also, portions **16*a* of glue stream 16 extend through holes 17 for interconnecting the intermediate or second ply 12 and ply 13 together. Therefore, upon removal of ply 11 from the unit set, plies 12 and 13 remain intact, separation of plies 11 and 12 separates all three plies of the set from one another, and removal of the ply 12 leaves plies 11 and 13** intact.

Each of the plies of unit set 10 is according to the invention coated both front and back with carbonless transfer material which comprises an initially colorless color-forming reactive component. A reactive component of each of the coatings 18 and 19 of ply 11 and of the back coating 21 of ply 12 is capable of reacting to produce a colored mark with a reactive component of each of the coatings 23, 24 of ply 13 and of front coating 22 of ply 12 upon coming into reactive contact therewith. Coatings 18, 19 and 21 comprise liquid fill material in tiny rupturable microscopic capsules, the fill comprising a first reactive component of the reactive system and being illustrated as a series of small circles containing a plus mark (⊕). Coatings 22, 23 and 24 comprise the second relative component of the reaction system which is usually a solid material containing a record-developing material which, when disposed against the coatings containing the first reactive component of the system, causes a mark to be produced upon the rupturing of the microcapsules. For example, a mark 25 may be impressed upon the upper surface of ply 11 by means of a stylus or machine key moving in the direction of arrow 26. Such mark is imaged as mark 27 on the top surface of ply 12 and further as mark 28 on the top surface of ply 13, as the microcapsules in coating 19 and in coating 21 rupture and the fill thereof spills out into contact to co-react with the reactive component in respective coatings 22 and 23. It should be pointed out that the second reactive component is illustrated as a series of plus marks (+).

Figure 3:
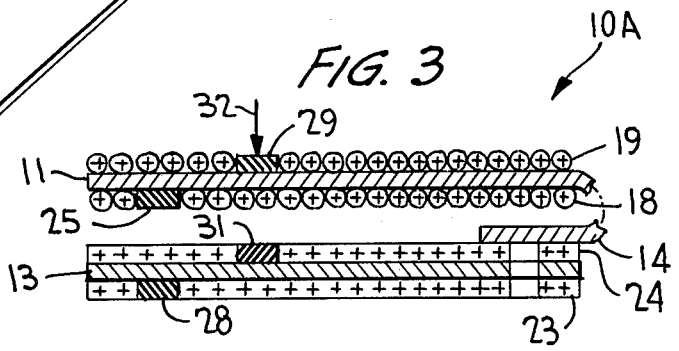
FIG. 3 is a cross-sectional view similar to FIG. 2 except that the assembly is shown rearranged with its intermediate ply removed and the remaining plies reversely folded to facilitate production of an image upon application of pressure to the reverse side of the set.

After writing on the set with the images transferred to the underlying plies as aforedescribed, intermediate ply 12 may be removed from the unit set as a retention copy so that, when interconnected plies 11 and 13 are received by the intended recipient, plies 11 and 13 may be reversely folded into the position shown in FIG. 3 whereupon coatings 18 and 24 are disposed in overlying relationship to one another. Glue flap 14 permits the top and bottom plies to be reversely folded to form a unit set 10A which facilitates the production of markings on opposite sides of plies 11 and 13. The co-reactants in the contacting coatings 18 and 24 of the plies co-react to produce an image 31 on ply 13 as a mark 29 is impressed on ply 11 by a stylus or machine key by applying pressure in the direction of arrow 32. Again, the microcapsules in coating 18 rupture so that the fill contained therein spills out to contact and co-reacts with the co-reactive material in coating 24.

The precursors and the acidic coatings useful in connection with the carbonless copying system of the invention are set forth in detail in U.S. Pat. No. 3,981,523 and therefore will not be described in detail herein. That patent disclosure is specifically incorporated herein by reference.

Figure 4:
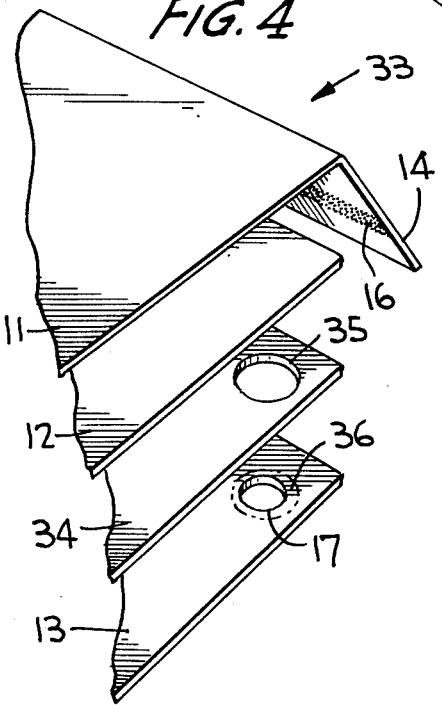
FIG. 4 is an expanded perspective view of a four-ply stubless assembly according to the invention.

A four-part unit set assembly 33 is shown in FIG. 4 as comprising superimposed top and bottom (first and fourth) plies 11 and 13 and intermediate (second and third) plies 12 and 34. This assembly is similar to assembly 10 shown in FIG. 1 with the exception of additional ply 34, and is the same as the assembly shown in the aforementioned U.S. Pat. No. 4,039,046 except for the carbonless copying system of the invention. The construction and operation of stubless assembly 33 herein is therefore not unlike that described in the '046 patent, the entire disclosure of which being specifically incorporated herein by reference.

Ply 34 has holes 35 provided along its marginal edge in alignment with holes 17 lying in ply 13. Holes 35 are of a larger size relative to holes 17 so as to provide an annular portion 36 in ply 13 which serves to mask glue spot **16*a* as it extends through the aligned holes (see FIG. 4). Also, ply 34 is coated front and back as at 37 and 38, such coatings being the same as coatings 22 and 21, respectively, on ply 12. Thus, a reactive component of each of the coatings 37 and 38 is capable of reacting, respectively, to produce a colored mark with a reactive component of each of the coatings 21 and 23 of plies 12 and 13 upon coming into reactive contact therewith. A mark 39, when impressed upon the upper surface of ply 11 by means of a stylus or machine key moving in the direction of arrow 41, is therefore imaged as marks 42, 43 and 44 on the respective top surfaces of underlying plies 12, 34 and 13 as the microcapsules in coatings 19, 21 and 38 rupture and the fill thereof respectively spills out into contact to co-react with the reactive component in respective coatings 22, 37 and 23**.

Figure 5:
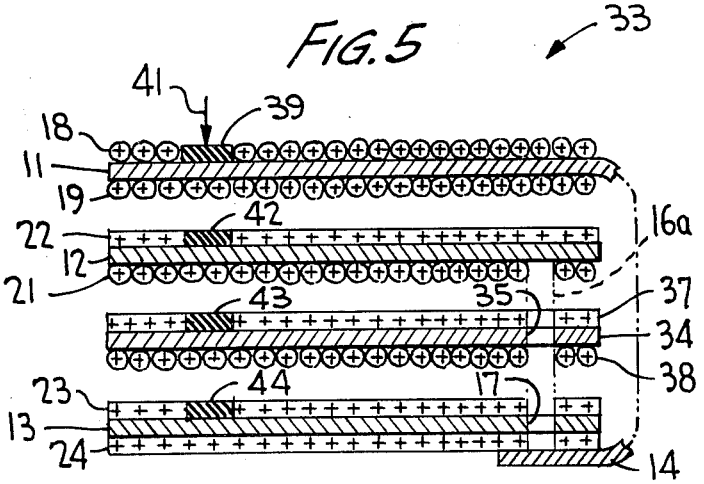
FIG. 5 is a cross-sectional view of the FIG. 4 assembly.

After writing on the set with the images transferred as shown in FIG. 5, intermediate plies 12 and 34 may be removed and plies 11 and 13 may be reversely folded into the position shown in FIG. 3 whereupon coatings 18 and 24 are disposed in overlying relationship to one another. Writing and image transfer on opposite sides of plies 11 and 13 may then be carried out similarly as described hereinabove with reference to FIG. 3.

In view of the foregoing, it can be seen that a simple and economical yet highly effective unit set of multiple plies has been devised using a unique arrangement of coatings comprising an initially colorless color-forming reactive component on each of the surfaces of the plies to facilitate image production on both sides of the top and bottom plies of the set. The particular arrangement of coatings on each of the surfaces of each of the plies facilitates the production of images on the intermediate and bottom plies as pressure is applied to the top ply of the set, whereafter the intermediate ply or plies may be removed and the top and bottom plies may be reversely folded so that their back surfaces overlie one another to facilitate the production of an image as a mark is impressed upon the reverse side of the set. Of course, additional intermediate plies 34 having the same front and back coatings may be utilized in each unit set 10 or 33, each additional ply 34 having holes 35 in alignment with smaller hole 17 so as to function the same as in FIG. 5, without departing from the scope of the present invention.

Obviously, many other modifications and variations of the invention are made possible in the light of the above teachings. It is therefore to be understood that within the scope of the appended claims the invention may be practiced otherwise than as specifically described.

What is claimed is:

1. A unit set of multiple plies, comprising at least superimposed first, second and third plies, said first ply having a folded flap removably connected along one edge thereof by a line of weakening extending along the fold between said first ply and said flap, said third ply having at least one hole lying adjacent one edge thereof, said flap underlying said third ply and having a quantity of detachable adhesive thereon securing said first ply to said third ply, a portion of said quantity of adhesive extending through said hole and securing said second and third plies together along one edge of said second ply, said edges of said plies lying at a common end of said unit set, and said plies each being devoid of any tear lines which may form a stub, each of said plies having on each of its surfaces a coating comprising an initially colorless color-forming reactive component, a reactive component of each of the coatings of said first ply being capable of reacting to produce a colored mark with a reactive component of each of the coatings of said third ply upon coming into reactive contact therewith, a reactive component of one and another of the coatings of said second ply being capable of respectively reacting to produce a colored mark with a reactive component of said coatings of said first ply and with a reactive component of said coatings of said third ply upon coming into reactive contact therewith, said plies being in overlying relationship to one another such that one of said coatings of said first ply is disposed against said one coating of said second ply and said another coating of said second ply is disposed against one of said coatings of said third ply, whereby upon application of pressure to said unit set, said one coating of said first ply is forced into said reactive contact with said one coating of said second ply and said another coating of said second ply is forced into said reactive contact with said one coating of said third ply to thereby produce colored marks on said second and third plies, said plies being capable of rearrangement such that, upon removal of said second ply, said first ply is made to overlie said third ply with its other coating disposed against the other coating of said third ply as said first and third plies are folded about said line of weakening, whereby upon application of pressure to the rearranged unit set said other coating of said first ply is forced into said reactive contact with said other coating of said third ply to thereby produce another colored mark on said third ply.

2. The unit set according to claim 1, wherein each of the coatings of said first ply and said another coating of said second ply comprises a plurality of pressure rupturable microcapsules containing said color-forming reactive component thereof, said microcapsules being rupturable upon application of said pressure to said unit set.

3. A unit set of multiple plies, comprising at least superimposed first, second, third and fourth plies, said first ply having a folded flap removably connected along one edge thereof by a line of weakening extending along the fold between said first ply and said flap, said third ply having at least one first hole of a predetermined first size lying adjacent one edge thereof, said flap underlying said fourth ply and having a quantity of detachable adhesive thereon securing said first ply to said fourth ply, said fourth ply having at least one second hole of a predetermined second size lying adjacent one edge thereof in axial alignment with said first hole, the size of said second hole being less than the size of said first hole, a portion of said quantity of adhesive extending through said first and second holes and securing said second and fourth plies together along one edge of said second ply, said quantity of adhesive lying inwardly of said first hole by reason of the difference in size between said holes to thereby immobilize said third ply in place, said edges of said plies lying at a common end of said unit set, and said plies each being devoid of any tear lines which may form a stub, each of said plies having on each of its surfaces a coating comprising an initially colorless color-forming reactive component, a reactive component of each of the coatings of said first ply being capable of reacting to produce a colored mark with a reactive component of each of the coatings of said fourth ply upon coming into reactive contact therewith, a reactive component of one and another of the coatings of said second and third plies being capable of respectively reacting with each other to produce a colored mark and with a reactive component of said coatings of said first ply and with a reactive component of said coatings of said third ply upon coming into reactive contact therewith, said plies being in overlying relationship to one another such that one of said coatings of said first ply is disposed against said one coating of said second ply and said another coating of said second ply is disposed against said one coating of said third ply and said another coating of said third ply is disposed against one of said coatings of said fourth ply, whereby upon application of pressure to said unit set, said one coating of said first ply is forced into said reactive contact with said one coating of said second ply and said another coating of said second ply is forced into said reactive contact with said one coating of said third ply and said another coating of said third ply is forced into said reactive contact with said one coating of said fourth ply to thereby produce colored marks on said second, third and fourth plies, said plies being capable of rearrangement such that, upon removal of said second and third plies, said first ply is made to overlie said fourth ply with its other coating disposed against the other coating of said fourth ply as said first and fourth plies are folded about said line of weakening, whereby upon application of pressure to the rearranged unit set said other coating of said first ply is forced into said reactive contact with said other coating of said fourth ply to thereby produce another colored mark on said fourth ply.

4. The unit set according to claim 3, wherein each of the coatings of said first ply and said another coating of said second and third plies comprises a plurality of pressure rupturable microcapsules containing said color-forming reactive component thereof, said microcapsules being rupturable upon application of said pressure to said unit set.

* * * * *